US005181658A

United States Patent [19]

Behar

[11] Patent Number: 5,181,658

[45] Date of Patent: Jan. 26, 1993

[54] NOZZLE WITH INCORPORATED VALVE

[75] Inventor: Alain Behar, Eu, France

[73] Assignee: Societe Francaise d'Aerosols et de Bonchage, Frivele-Escarbotin, France

[21] Appl. No.: 746,440

[22] Filed: Aug. 16, 1991

[30] Foreign Application Priority Data

Aug. 17, 1990 [FR] France ..... 90 10441

[51] Int. Cl.[5] ..... B05B 11/02; B05B 1/34

[52] U.S. Cl. ..... 239/493; 239/571; 222/380

[58] Field of Search ..... 239/464, 491, 492, 493, 239/482, 483, 333, 571; 222/380

[56] References Cited

U.S. PATENT DOCUMENTS

| | | | |
|---|---|---|---|
| 1,259,052 | 3/1918 | Starr | 239/493 |
| 1,453,161 | 4/1923 | Murphy et al. | 239/493 |
| 4,109,869 | 8/1978 | Brockelsby et al. | 239/491 |
| 4,182,496 | 1/1980 | Burke | 239/492 |
| 4,358,057 | 11/1982 | Burke | 239/492 |
| 4,538,745 | 9/1985 | Dunning et al. | 222/153 |
| 4,673,110 | 6/1987 | Workum | 239/493 |
| 4,944,431 | 7/1990 | Blake | 222/380 |

FOREIGN PATENT DOCUMENTS

| | | |
|---|---|---|
| 2635084 | 2/1990 | France . |
| WO85/05572 | 12/1985 | World Int. Prop. O. . |

*Primary Examiner*—Andres Kashnikow
*Assistant Examiner*—Karen B. Merritt
*Attorney, Agent, or Firm*—Pennie & Edmonds

[57] ABSTRACT

An atomizing nozzle usable on a vaporizer or atomizer is provided, having a unified core and valve member and a diaphragm perforated by a narrow orifice. The unitary member is axially mobile and laterally guided in a chamber within the nozzle. Additionally, the unified member has, on its end remote from the orifice, a concave circular cup in which the edges of the cup are turned toward the orifice, and, on its end nearest to the orifice, a core portion which cooperates with the diaphragm to form a system of turbulent channels which supply the orifice.

9 Claims, 1 Drawing Sheet

NOZZLE WITH INCORPORATED VALVE

TECHNICAL FIELD

The present invention generally relates to a nozzle usable on a vaporizer or atomizer.

BACKGROUND OF THE INVENTION

The spraying of many different substances in atomized form (i.e., fine mist form) is possible using existing manually-operated devices called atomizers and vaporizers, many types of which are often small in size. The operation of these devices is straightforward. To begin with, they utilize some type of container to store the active substance either in, or suspended in, a liquid medium. When a spray is desired, an operator acts upon a control mechanism (also called a control head) in order to expel the substance out of the container. Pressure created by the control mechanism forces the substance through an atomizing nozzle which expels the atomized substance to the outside air through a small orifice.

In very general terms, the nozzle is sometimes placed on the control mechanism which is fitted to a distributor in the form of a valve or pump having an axial spray nozzle. The head may also be provided with an appropriate end piece which acts as the atomizer.

An atomizing nozzle requires some means by which a substance in its liquid form can be transformed into its atomized form. Several means exist which adequately perform this function. They generally require the use of two parts acting in concert—a core and a diaphragm. When a liquid substance is forced under adequate pressure through the nozzle, the internal axial core cooperates with the diaphragm and forms a system of turbulent channels. This turbulence effectively serves to transform the substance from its liquid to its atomized form. This model is typically assembled such that its diaphragm and core are permanently secured together. In assembling this model, the diaphragm typically is placed at the bottom of a cap. The cap is then placed over the core, as well as over the end of the nozzle, thus bringing the core and the diaphragm into permanent contact. The cap can then be permanently affixed to the nozzle by welding it thereto. Alternatively, the core is sometimes fuzed to the diaphragm before the cap is welded to the nozzle. However, regardless of exactly how the particular atomizing means is assembled, the atomizing process is carried out by two cooperating parts which are separately molded and then assembled.

The ability to effectively seal an atomizer while not in use such that no air enters and no liquid leaks therefrom is a very desirable feature from the standpoints of hygiene, preservation of the substance, and prevention of blockages due to liquid seeping through, and drying in, the nozzle between uses. There exists various types of valves which incorporate this feature, and even valves which incorporate this feature without requiring external plugs or stoppers and without interfering with the satisfactory operation of the nozzle.

One such valve providing an effective seal is described and illustrated in the French Patent FR-A-2 635 084 to Bougamont and Behar. The patent describes an atomizing nozzle having a diaphragm, a core and a valve member axially slidble within a chamber of the nozzle. On its end nearest the nozzle's orifice, the valve member has a concave circular cup in which the flexible edges of the cup are turned toward the orifice. On its end farther from the nozzle's orifice, the valve member has a stem which provides the member with its lateral guidance. When the nozzle is not in use, the edges of the cup block the passage through the nozzle chamber thus making the seal. And because the valve member remains axially mobile, it can adapt freely to any slight pressure variations to which it can be exposed, thereby maintaining an effective seal during the non-use period.

In this particular valve system, however, the core used to form turbulent channels and the valve member are two separate parts. And although the patent discloses that the nozzle can optionally be assembled in such a way that the core and valve member are secured together, this configuration would eliminate the valve member's axial mobility. In this latter option, therefore, the edge of the valve would appear to function in a less satisfactory manner, the sealing being less precise and less durable.

SUMMARY OF THE INVENTION

It is therefore an object of this invention to provide an atomizing nozzle which reduces the number of preassembly parts, yet maintains an effective atomizing process, as well as an effective seal when the nozzle is not in use.

It is another object of the invention to provide a design for an atomizing nozzle which facilitates easier and faster assembly.

These and other objects which would be apparent to one skilled in the art are achieved by the atomizing nozzle of the present invention, which generally consists of two parts acting in concert with one another—a unitary core and valve member and a diaphragm perforated by a narrow orifice. The unitary core and valve member is axially mobile and laterally guided in a chamber within the nozzle. Additionally, the unitary member has, on its end remote from the orifice, a concave circular cup in which the edges are turned toward the orifice, and, on its end nearest to the orifice, a core which cooperates with the diaphragm in order to form a system of turbulent channels which supply the orifice.

The nozzle can be produced easily and inexpensively in a miniature size since it consists of only two parts which can be simply molded and assembled thereby reducing manufacturing costs. The present invention achieves these advances while still maintaining both an effective seal when the atomizer is not in use and also an effective atomizing process.

BRIEF DESCRIPTION OF THE DRAWINGS

These and other objects, features and advantages of the invention will be more readily apparent from the following detailed description of the invention in which.

DESCRIPTION OF THE PREFERRED EMBODIMENTS

Figure 1:
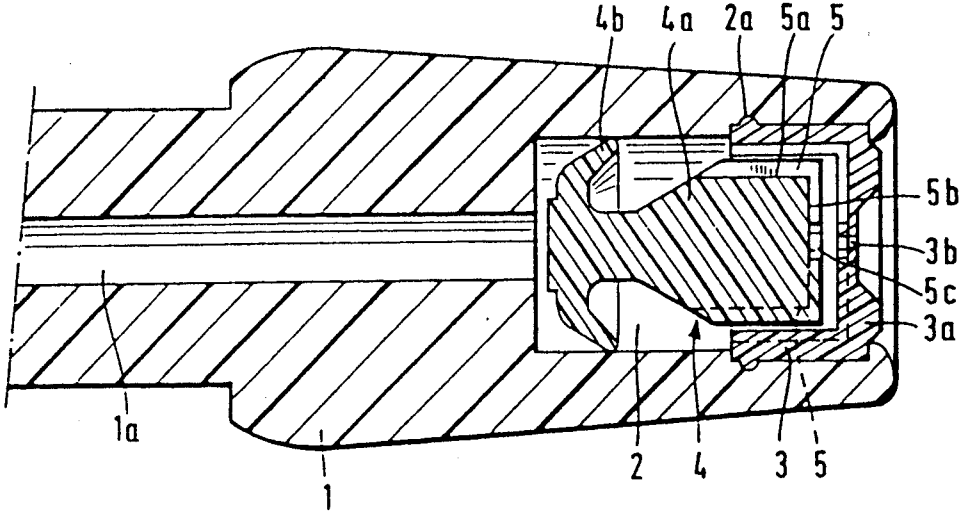
FIG. 1 is a longitudinal section view of one preferred embodiment of the atomizing valve of the present invention.

Referring now to the drawings, and more particularly to FIG. 1, there is shown the end of an end piece 1 of an atomizer traversed by a channel 1*a* and having a recess 2 for receiving the nozzle according to the present invention. Into this recess 2 is engaged a short sleeve or cap member 3, whose bottom forms a diaphragm 3*a* perforated by an axial orifice 3*b*. The cap member 3 encloses a unitary core and valve member 4 having a stem 4*a* which carries a truncated cone-shaped cup 4*b*. The cup has a flexible circular lip, the periphery of which is shown in contact with the wall of the recess; and the cup is oriented so that its concavity is turned towards the side nearer the orifice 3*b*.

The unitary core and valve member 4 is axially mobile within the recess because the cap member 3 is not inserted down to the bottom, but only up to an appropriate abutment, namely a shoulder 2*a* in the recess, leaving space for axial movement. In addition there is negligible or very little friction between the unitary member and the walls of the recess. With this axial mobility, the unified member 4 can therefore adapt freely to the slight pressure variations to which it can be exposed as a result of expansion and therefore maintains a very good sealing action.

Stem 4*a* provides the same function as the core of prior art nozzles. The stem 4*a* is provided with grooves 5, having a lateral portion 5*a*, front face portion 5*b* and a central cavity 5*c*. Preferably, the lateral portion 5*a* is parallel to the axis while the front face portion 5*b* extends obliquely (and not along radial lines) from the sides of stem 4*a* to the central cavity. The central cavity, in turn, is aligned with orifice 3*b*.

When a user wishes to expel a liquid, the pressure increase initially produced pushes unitary member 4 against the diaphragm 3*a*. It is only then, under the desired use pressure, that the lip of cup 4*b* gives way and permits the passage of liquid. Passing through grooves 5, the liquid is rapidly rotated before being expelled through the orifice and is therefore finally atomized.

While the liquid is passing through the nozzle there is an adequate pressure drop to maintain the core against the diaphragm so that the central cavity 5*c* is in close proximity to orifice 3*b*. When the pressure is interrupted, the unitary member is free to slightly move back, thereby relieving the tight lip.

Figure 2:
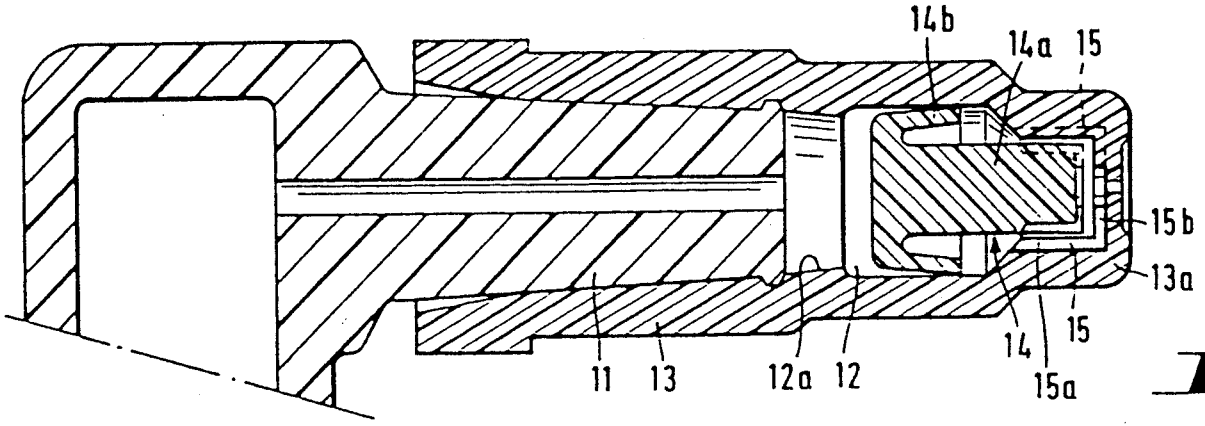
FIG. 2 is a longitudinal section view of a second preferred embodiment of the atomizing valve of the present invention.

The device shown in FIG. 2 is based on an identical principle. However, in this embodiment a cap member in the form of a finger-like sleeve 13 is engaged on a male end piece 11 which extends from a container which stores the liquid. Once engaged on male end piece 11, the sleeve 13 defines a chamber 12 sealed by the diaphragm 13*a*. Inside the chamber 12 is an axially mobile unitary core and valve member 14, having a guidance stem 14*a* which carries a cup 14*b*. Although the lip of the cup 14*b* rubs against the chamber wall, a shoulder with a conical inlet 12*a* can be provided to prevent member 14 from escaping during assembly. As compared to the first embodiment, the stem 14*a* of the second embodiment is stronger and the lip of the cup 14*a* turned down more. However, the operation remains unchanged, and the expulsion pressure is still dependent on the flexibility of the lip of the cup.

The stem 14*a* is entirely cylindrical and has no undercuts. This design facilitates the molding of the member. On the inner wall of the chamber 12 enclosed within the sleeve 13 are grooves 15 or similar passages having a lateral portion 15*a* and a front face portion 15*b*. Portion 15*a* or 15*b* could also be placed on stem 14*a* and the other portion placed on sleeve 13. An intermediate channel would avoid having to orient the parts relative to one other to ensure that portions 15*a* and 15*b* interconnect. However, this would make the parts more complicated and is not normally necessary.

In each of the two embodiments described, the number of parts is reduced to two and their assembly is simplified, so that manufacture is possible at a particularly advantageous price.

While various advantageous embodiments have been chosen to illustrate the present invention, it will be understood by those skilled in the art that various changes and modifications can be made therein without departing from the scope of the invention as defined in the appended claims. For example grooves 15 could be defined partially in opposing faces of sleeve 13 and stem 14*a* so that the complete groove is formed when stem 14*a* and sleeve 13 are pushed into contact with each other.

What is claimed is:

1. An atomizing nozzle comprising:

a diaphragm member mounted on a housing so as to enclose a chamber therewith, said member being perforated by an axial orifice wherein said orifice is located at the distal end of said nozzle; and a unitary core and valve member comprising a valve portion and a core portion axially mobile and laterally guided within said chamber, said valve portion comprising a concave circular cup on an edge of said member remote from said orifice in which the edges of said cup engage an interior periphery of said chamber and are turned toward said orifice, and said core portion on an end of said member nearer to said orifice cooperating with said diaphragm to form a system of turbulent channels which supply said orifice.

2. The atomizing nozzle according to claim 1 wherein said core portion has a diameter which at any point is no smaller in comparison to its diameter at any point nearer to said orifice.

3. The atomizing nozzle, according to claim 1 wherein a surface of said core portion is grooved.

4. The atomizing nozzle according to claim 1 wherein said diaphragm member is part of a cap member which fits in a recess formed in the housing and whose internal sides serve to laterally guide said core portion.

5. The atomizing nozzle according to claim 4 wherein said cap member is internally grooved.

6. The atomizing nozzle according to claim 4 wherein said cap member is internally grooved and a surface of said core portion is grooved, and wherein said grooves interconnect or mate.

7. The atomizing nozzle according to claim 1 wherein said diaphragm member is part of a cap member having a finger shape that is fitted over said housing to enclose said chamber and whose internal sides serve to laterally guide unitary core and valve member.

8. The atomizing nozzle according to claim 7 wherein said cap member is internally grooved.

9. The atomizing nozzle according to claim 7 wherein said cap member is internally grooved and a surface of said core portion is grooved, and wherein said grooves interconnect or mate.

* * * * *